US007667119B1

(12) United States Patent
Schlapkohl

(10) Patent No.: US 7,667,119 B1
(45) Date of Patent: Feb. 23, 2010

(54) PORTABLE KEYBOARD SYSTEM

(75) Inventor: Thomas P. Schlapkohl, West Des Moines, IA (US)

(73) Assignee: Schlapkohl Investments, West Des Moines, IA (US)

( * ) Notice: Subject to any disclaimer, the term of this patent is extended or adjusted under 35 U.S.C. 154(b) by 0 days.

(21) Appl. No.: 12/220,836

(22) Filed: Jul. 29, 2008

(51) Int. Cl.
*G10C 3/12* (2006.01)

(52) U.S. Cl. ..... 84/424; 84/423 R; 84/376 R

(58) Field of Classification Search ..... 84/424, 84/376 R, 423 R
See application file for complete search history.

(56) References Cited

U.S. PATENT DOCUMENTS 2,084,266 A * 6/1937 George et al. ..... 84/365
2,134,176 A * 10/1938 Demianenko ..... 84/376 R
2,701,498 A * 2/1955 Feilhaber et al. ..... 84/423 R
2,754,715 A * 7/1956 Ruben ..... 84/442
3,311,010 A * 3/1967 Ward ..... 84/376 EA
3,335,629 A * 8/1967 Brodin ..... 84/1
3,478,159 A * 11/1969 Olson ..... 84/719
3,695,138 A * 10/1972 Andersen ..... 84/470 R
3,744,368 A * 7/1973 Lady ..... 84/470 R
3,750,516 A * 8/1973 Olson ..... 84/470 R
3,757,024 A * 9/1973 Stinson et al. ..... 84/716
3,776,089 A * 12/1973 Cohen ..... 84/376 R
4,170,916 A * 10/1979 Fritz et al. ..... 84/689
4,617,851 A * 10/1986 Sato ..... 84/622
4,884,488 A * 12/1989 Curletto ..... 84/376 R
5,463,925 A * 11/1995 Galocy ..... 84/423 R
6,946,594 B2 * 9/2005 Bruti et al. ..... 84/604
7,361,826 B2 * 4/2008 Brun ..... 84/719

* cited by examiner

*Primary Examiner*—Jeffrey Donels
*Assistant Examiner*—Robert W Horn
(74) *Attorney, Agent, or Firm*—Brett Trout

(57) ABSTRACT

A portable keyboard system having a pair of keyboards rigidly secured to and directed outward from one another. The keyboard system is secured to a user with shoulder straps, which allow the user to control one keyboard with each hand. The keyboards are separately adjustable across several sound and intensity parameters.

6 Claims, 3 Drawing Sheets

PORTABLE KEYBOARD SYSTEM

BACKGROUND OF THE INVENTION

1. Field of the Invention

The present invention relates to a portable keyboard system and, more particularly, to a portable keyboard system having a pair of opposing keyboards positioned in front of a user and secured around a user's neck.

2. Description of the Prior Art

Accordions are well known in the art. Accordions typically comprise a keyboard on one side and a plurality of buttons on the other. The two sides are connected by a bellows which the user expands and contracts to draw air through reed blocks controlled by the keyboard and buttons. Typically, the keyboard is a treble keyboard which raises valves on the reed block to select precisely where air passes through the reed block to generate various sounds. Accordions also may have treble switches to modify the sound as desired. The buttons are typically referred to as base buttons and are used to manipulate the valves which control the flow of air through a base reed block. Base switches are also typically provided to modify the sound associated with the base buttons. While accordions work well to produce a predefined sound, the unique nature of the base buttons often makes the instrument difficult to learn. The accordion is also limited to a particular sound. It would, therefore, be desirable to provide a portable instrument with a more familiar user interface and with the option of providing additional sounds.

It is also known in the art to provide a single keyboard around a musician's neck. Such "Keytars" are basically portable synthesizers. While the Keytar provides many options associated with synthesizers, including controls to modulate nearly every aspect of the sound, the Keytar provides only a short keyboard typically played with one hand. Although two hands may be used on the Keytar, the placement of the keyboard facing upward and toward one side of the user makes the use of a Keytar by both hands awkward. It would, therefore, be desirable to provide a musical instrument with a broader range of notes and which may be more easily played with both hands.

While accordions are played with both hands, they are often heavy, bulky and are taxing and difficult to operate. While Keytars avoid some of the problems associated with accordions, the small keyboard and difficulty in operating the keyboard with two hands limits the use of the Keytar. It would, therefore, be desirable to provide a musical instrument which is lightweight, easy to operate with both hands, is adaptable for ease of use for musicians trained in other instruments, such as the piano or synthesizer, and which is easily adaptable to provide a plurality of different sounds.

SUMMARY OF THE INVENTION

In an advantage provided by this invention, a portable keyboard system is provided which is of a lightweight construction.

Advantageously, this invention provides a portable keyboard system which allows both hands to play keyboards simultaneously.

Advantageously, this invention provides a portable keyboard system which is adaptable to provide a variety of sounds.

Advantageously, this invention provides a portable keyboard system which does not require mechanical expansion and compression to generate sound.

In an embodiment of this invention, a musical instrument is provided with a pair of outwardly facing opposed keyboards. The musical instrument is hung around a musician's neck with one of the keyboards accessible to each hand. Preferably, the keyboards are fixed in relationship to one another and angled slightly toward the user to facilitate hand placement during playing of the musical instrument.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
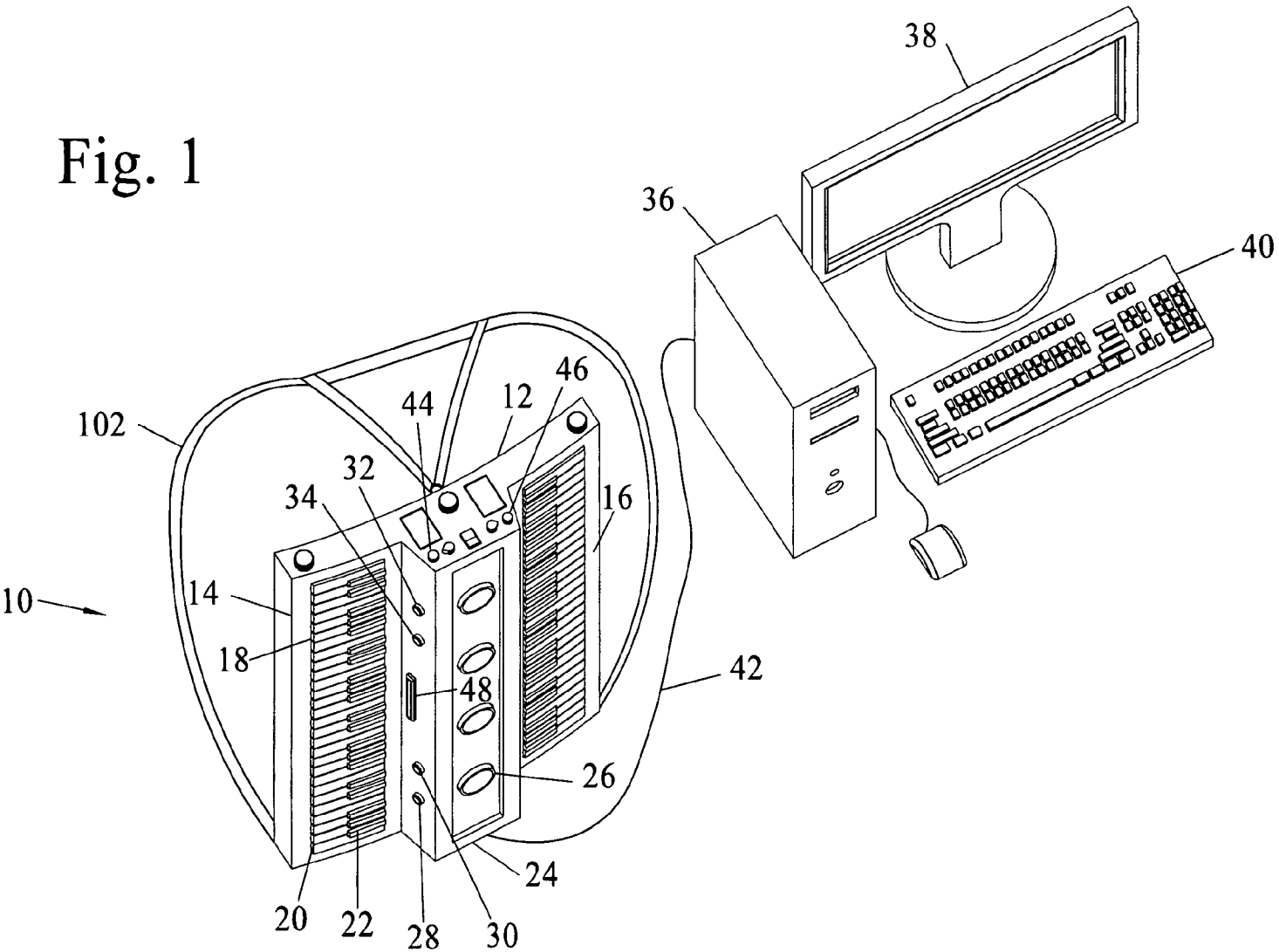
FIG. 1 illustrates a perspective view of the portable keyboard system of the present invention.

With reference to the drawings, a portable keyboard system is shown generally as (10) in FIG. 1. The system (10) includes a frame (12) securing a treble keyboard (14) to a base keyboard (16). The keyboards (14) and (16) are preferably of a type known in the art, utilizing a frequency synthesizer microprocessor to generate signals representing various sounds. As known in the art, the microprocessor may be of a type designed to store recordings of actual instruments and to reproduce the sounds at various pitches associated with the various keys (18). Alternatively, or in addition, the keyboards (14) and (16) may be programmed to represent a predetermined tone associated with each key (18). In the preferred embodiment, the keyboards (14) and (16) include white keys (20) and black keys (22) arranged in a standard keyboard pattern such as that shown in FIG. 1.

Provided between the keyboards (14) and (16) is a speaker box (24) housing a plurality of speakers (26). The speakers (26) may be of any type known in the art and may be, if desired, of various sizes and functionalities. While the speakers (26) may placed anywhere on the frame (12), the center provision of the speaker box (24) and speakers (26) allows for the sound to be forwardly directed toward the listener. Also provided on the speaker box (24) are "preset" buttons (28), (30), (32) and (34), which may be programmed using an external central processing unit (36), display (38) and input devices (40), such as a keyboard and mouse coupled to the system (10) by a standard USB 2.0 Musical Instrument Digital Interface (MIDI) interface (42) or any interface known in the art.

Alternatively, the preset buttons (28-34) may be programmed utilizing voice (44) and effect (46) selectors secured to the top of the frame (12). Once a desired voice and effect is selected, the desired preset buttons (28-34) may be held down for four seconds to map the particular preset button (28-34) to the particular voice and effect chosen with the selectors (44) and (46).

Figure 2:
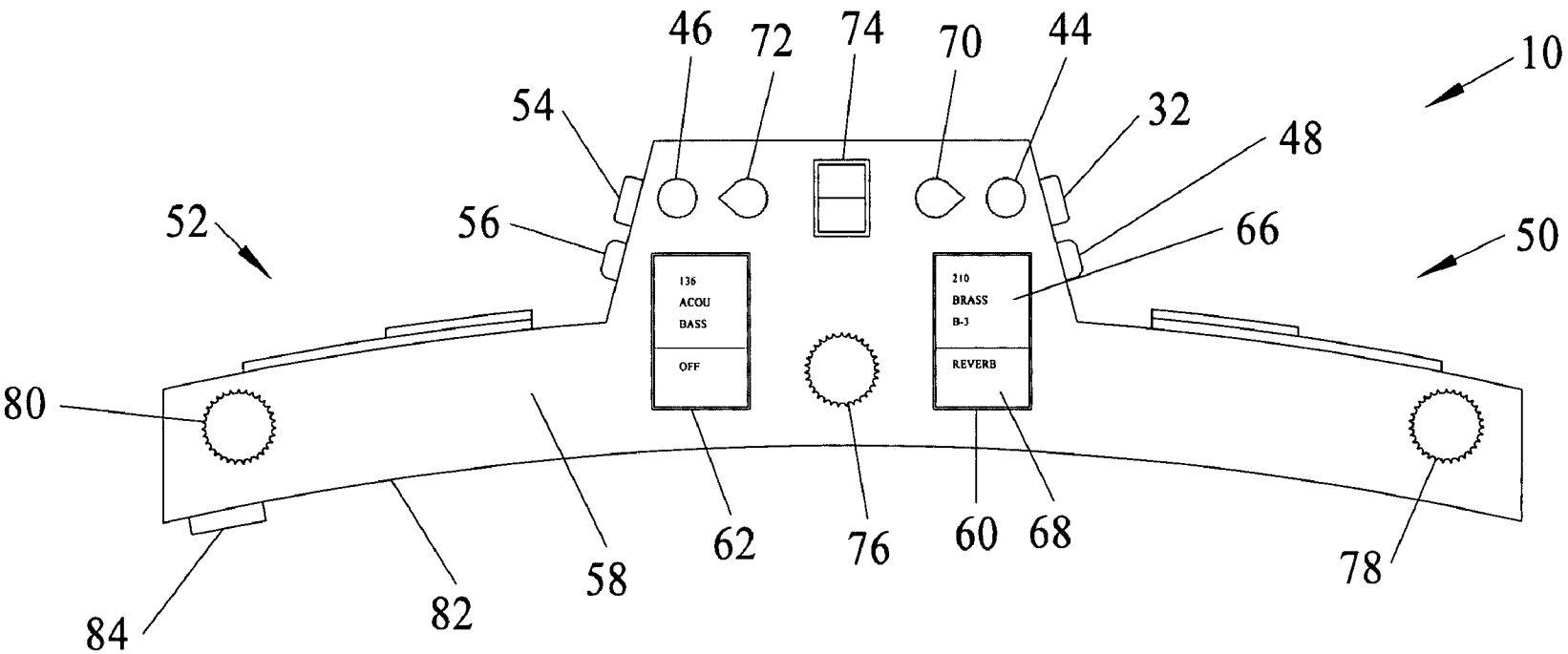
FIG. 2 illustrates a top elevation of the portable keyboard system of FIG. 1.

Also provided on the speaker box (24) is a spill bar (48) for toggling the portable keyboard system (10) between the presets associated with the preset buttons (28-34) and a manual preset, such as the replication of a standard accordion. As shown in FIG. 2, the base side (52) of the portable keyboard system (10) is also provided with preset buttons (54) and a spill bar (56).

The top (58) of the portable keyboard system (10) is provided with the selectors (44) and (46). In the preferred embodiment, the right voice selector wheel (44) is coupled to a first LCD screen (60) and the left voice selector wheel (46) is coupled to a second LCD screen (62). As shown in FIG. 2, the screens (60) and (62) are provided with a first section (66), which changes as the selectors (44) and (46) are rotated to display the exact instrument or sound the associated keyboard (14) and (16) is producing. Each LCD screen (62) and (64) is provided with a second section (68) which identifies whether each keyboard (14) and (16) is set to reverberation, vibrato or off. The setting associated with the second section (68) is controlled by effect selector intensity dials (70) and (72) which act as effect selectors. In the preferred embodiment, the intensity dials (70) and (72) have "vibrato," "reverberation" and "off" positions. The selector dials (70) and (72) may be provided with any desired number and type of effects.

Also provided on the top (58) of the portable keyboard system (10) is an on/off rocker switch (74) and a master volume control knob (76). Provided on the ends of the top (58) of the portable keyboard system (10) are manual volume control dials (78) and (80), which allow the user to control the volume associated with each keyboard (14) and (16) independently. Provided on the back (82) of the portable keyboard system (10) is a button (84) to switch between chorale and tremolo.

Figure 3:
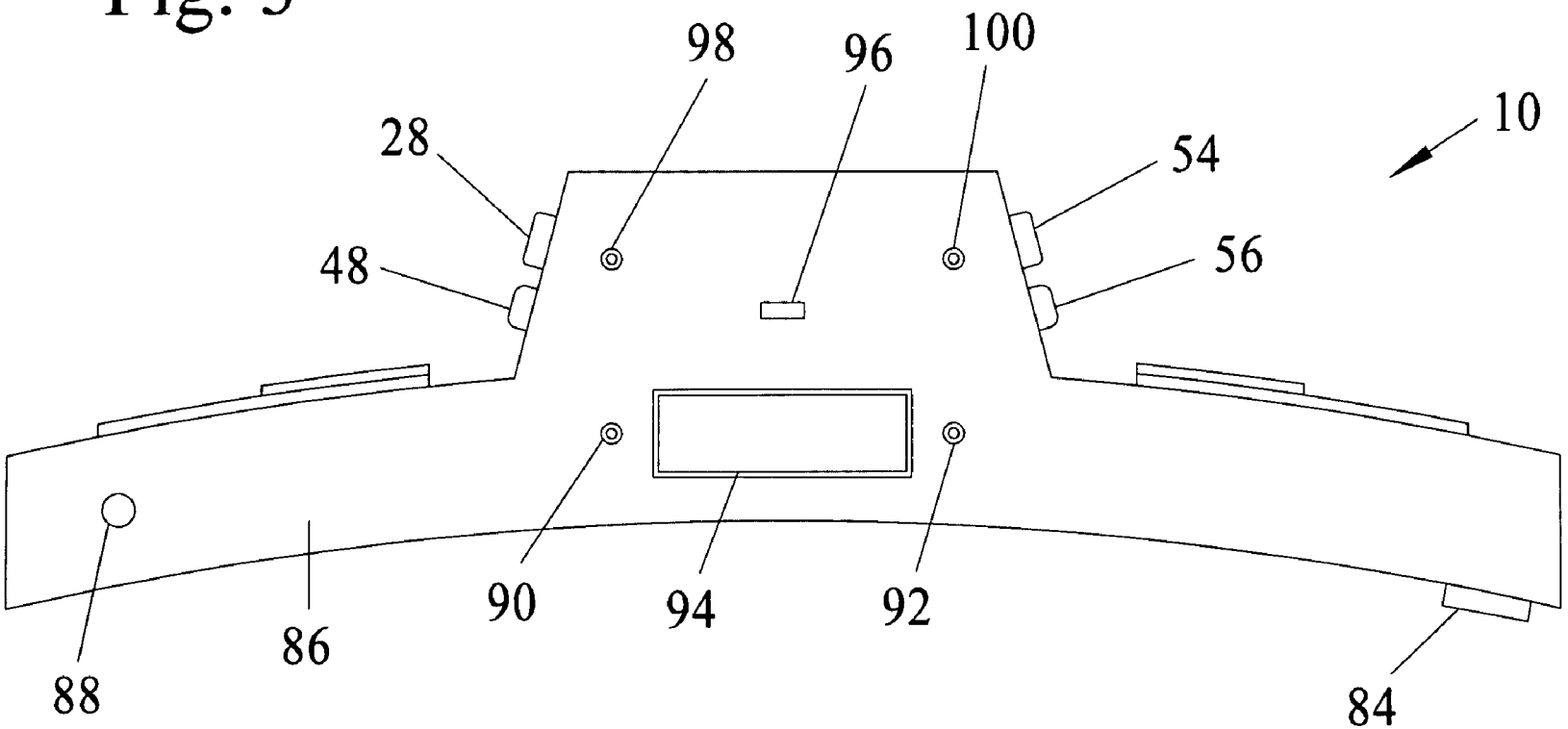
FIG. 3 illustrates a bottom elevation of the portable keyboard system of FIG. 1.

As shown in FIG. 3, the bottom (86) of the portable keyboard system (10) is provided on one end with an alternating current power input (88), such as those known in the art. The portable keyboard system (10) is also provided with a Leslie pedal jack (90) and an amplifier jack (92). Provided between the jacks (90) and (92) is a battery pack (94), which is preferably of a nickel metal hydride construction for use when alternating current power input is not available. The portable keyboard system (10) is also provided with a USB 2.0 jack (96), but may, of course, be provided with any type of computer input jack. As shown in FIG. 3, the bottom (86) of the portable keyboard system (10) is also provided with a MIDI input jack (98) and a MIDI output jack (100).

When it is desired to play the portable keyboard system of the present invention (10), a shoulder strap (102) such as those known in the art is secured to the top (58) and bottom (86) of the portable keyboard system (10) and provided over the shoulders of a user. The power input (88) is coupled to an alternating current power source and the selector dials (44) and (46) are adjusted until the desired preset sound appears in the LCD screens (62) and (64). The intensity dials (70) and (72) are then adjusted to the desired intensity and, if desired, the switch (84) is adjusted to select chorale or tremolo. Thereafter, the rocker switch (74) is actuated to power the portable keyboard system (10) and the master control volume (76) and individual volume controls (78) and (80) are adjusted to the desired volume. The portable keyboard system (10) may be played immediately or coupled to a central processing unit (36), MIDI inputs or outputs, an amplifier or pedal as desired.

While the portable keyboard system (10) may be of any desired configuration, in the preferred embodiment, the keyboards (14) and (16) are preferably less than one and one-half meters in length, and more preferably less than one meter in length. Additionally, the portable keyboard system (10) is preferably less than fifty kilograms, more preferably less than forty kilograms and, most preferably, less than twenty-five kilograms. The keyboards (14) and (16) are rigidly coupled to one another at an angle preferably in a non-parallel orientation extending outwardly away from one another at an angle more than one-hundred thirty-five degrees relative to one another. While the keyboards (14) and (16) may be secured at an angle one-hundred eighty degrees relative to one another, such an orientation is not as desirable as an angle slightly less than one-hundred eighty degrees. Similarly, while the keyboards (14) and (16) may be secured at an angle ninety degrees relative to one another, in the preferred embodiment the keyboards are angled at an angle greater than ninety degrees relative to one another.

Although the invention has been described with respect to a preferred embodiment thereof, it is to be understood that it is not to be so limited since changes and modifications can be made therein which are within the full, intended scope of this invention as defined by the appended claims.

What is claimed is:

1. A musical instrument comprising:

(a) a first keyboard comprising:

(i) a first plurality of long keys;

(ii) a first plurality of short keys;

(iii) a first side;

(iv) a second side; and (v) wherein said first side is closer to said first plurality of short keys than said second side;

(b) a second keyboard comprising:

(i) a second plurality of long keys;

(ii) a second plurality of short keys;

(iii) a third side;

(iv) a fourth side; and (v) wherein said third side is closer to said second plurality of short keys than said fourth side;

(c) wherein a distance between said first side and said third side is shorter than a distance between said second side and said fourth side; and (d) a shoulder harness coupled to said first keyboard and said second keyboard, wherein the first and second keyboards are arranged by the harness in a playable position on the chest of a single musician, and the body holding the first and second keyboards are in a rigid, fixed relationship to each other.

2. The musical instrument of claim 1, wherein said first keyboard is provided in a non-parallel orientation relative to said second keyboard.

3. The musical instrument of claim 1, further comprising a speaker provided between said first keyboard and said second keyboard.

4. The musical instrument of claim 1, wherein said first keyboard is less than one meter in length.

5. The musical instrument of claim 4, wherein the musical instrument weighs less than fifty kilograms.

6. The musical instrument of claim 1, wherein said first keyboard is rigidly secured relative to said second keyboard.

* * * * *